United States Patent [19]

Frangatos

[11] Patent Number: 4,536,312

[45] Date of Patent: Aug. 20, 1985

[54] SULFURIZED AMINE CONDENSATION PRODUCTS AND LUBRICANT COMPOSITIONS CONTAINING SAME

[75] Inventor: Gerassimos Frangatos, Haddonfield, N.J.

[73] Assignee: Mobil Oil Corporation, New York, N.Y.

[21] Appl. No.: 591,648

[22] Filed: Mar. 20, 1984

Related U.S. Application Data

[63] Continuation-in-part of Ser. No. 366,953, Apr. 9, 1982, abandoned.

[51] Int. Cl.[3] ..... C10M 1/38

[52] U.S. Cl. ..... 252/47.5; 546/308

[58] Field of Search ..... 252/47.5; 260/128, 129, 260/130

[56] References Cited

U.S. PATENT DOCUMENTS

| | | | |
|---|---|---|---|
| 2,945,863 | 7/1960 | Buc et al. | 252/51.5 A X |
| 3,303,131 | 2/1967 | Low et al. | 252/51.5 A X |
| 3,390,086 | 6/1968 | O'Halloran | 252/47.5 |
| 3,405,064 | 10/1968 | Miller | 252/51.5 A |
| 3,451,166 | 6/1969 | Panzer | 252/47.5 |
| 3,452,002 | 6/1969 | Brasch | 252/51.5 A X |
| 3,555,035 | 1/1971 | Meisels et al. | 546/308 |
| 3,630,902 | 12/1971 | Coupland et al. | 252/51.5 A |
| 3,884,822 | 5/1975 | Gemmill, Jr. | 252/51.5 A |
| 4,201,684 | 5/1980 | Malec | 252/47.5 |
| 4,295,982 | 10/1981 | Frangatos | 252/47.5 X |

*Primary Examiner*—Andrew H. Metz

*Attorney, Agent, or Firm*—Alexander J. McKillop; Michael G. Gilman; Howard M. Flournoy

[57] ABSTRACT

The present invention is directed to condensation products of amino substituted nitrogen heterocycles, such as pyridines, with unsaturated carboxylic acids as well as their sulfurization products. It has been found that additive amounts of such condensation reaction products when incorporated into lubricant compositions provide effective anti-rust properties against, for example, salt water corrosion.

12 Claims, No Drawings

SULFURIZED AMINE CONDENSATION PRODUCTS AND LUBRICANT COMPOSITIONS CONTAINING SAME

CROSS REFERENCE TO RELATED APPLICATIONS

This application is a continuation-in-part of application Ser. No. 366,953, entitled Amine Condensation Products and Lubricant Compositions Containing Same, filed Apr. 9, 1982 and now abandoned.

BACKGROUND OF THE INVENTION

The present invention relates to novel products and to lubricant compositions containing such new products. These products are made by the condensation reaction of, for example, aminopyridine compounds with unsaturated monocarboxylic acids. The present invention is also directed to sulfurization reaction products of the above-referred to condensation products.

It is well known that, under certain conditions, metal parts being lubricated will rust. That is, when certain types of materials that are normally susceptible to deterioration by oxidation or by corrosion come into contact with various organic media, rust may form. Organic compositions in both the liquid and solid form can induce such corrosion or oxidation. For example, it is known that liquid hydrocarbons in the form of various fuel oils, such as petroleum distillate hydrocarbon fuels, lubricating oils, or greases therefrom, tend to accumulate considerable quantities of water when maintained for long periods of time in storage vessels. Furthermore, air oxidation of the base oil stock of fuel oils, lubricating oils or greases during their operative use leads to additional water formation. When the moisture containing oils or greases are subsequently brought into contact with metal surfaces in their functional environments, deterioration of said surfaces as a result of rust and corrosion occurs.

Many materials have been advanced for use as rust inhibiting additives for organic compositions. Several of these involve compounds containing a nitrogen atom, such as glyoxalidines (U.S. Pat. No. 2,668,100) and the like. Furthermore, amines such as the alkanolamines have been disclosed as being anti-rust agents per se. (U.S. Pat. No. 4,295,982 discribes anti-rust additives which are the reaction products obtained by reacting an aminoguanidine or its salt with an unsaturated monocarboxylic acid. However, no art known to the applicant anticipates or suggests that an effective anticorrosion product can be made by the reaction of the selected materials in accordance with this invention as set forth in detail hereinafter.

SUMMARY OF THE INVENTION

The present invention is directed to new compounds which comprise a condensation product which is obtained by reacting an amino substituted heterocyclic nitrogen compound with an unsaturated monocarboxylic acid. It has now been found that the novel products of such condensation reactions act as rust inhibitors when incorporated in additive amounts into lubricant compositions. It has further been found that when these condensation reaction products are sulfurized their anti-rust activity is even further enhanced.

DESCRIPTION OF SPECIFIC EMBODIMENTS

Applicant has found that certain amides, which are obtained from the condensation of amino substituted nitrogen containing heterocycles wherein the nitrogen is a ring nitrogen and an unsaturated carboxylic acid or a mixture of unsaturated carboxylic acids, are effective rust inhibitors. Therefore, the present invention is more specifically directed to products obtained by the reaction of a hydrocarbyl amino substituted nitrogen heterocyclic compound with an unsaturated monocarboxylic acid in substantially stoichiometric amounts at a temperature of from about 150° to 275° C. for a time sufficient to produce the desired product. Additionally the sulfurization products of such condensation reactions are also highly effective as rust inhibitors and particularly as salt water corrosion inhibitors.

Applicant, while not wishing to be held to a particular theory, believes that the rigid, non-planar configuration of these amino substituted nitrogen heterocycles and their susceptibility to asymmetric solvation by polar species renders them effective in this application. Further, by virtue of the presence of a sequence of nitrogen containing sites as potential substrata for fixed nitroxyl group formation, applicant believes that as a result of such structure the operative forces which produce the anti-rust activity of such systems may be explained. Although, in the following examples specific amino substituted pyridines are employed in the condensation reactions to produce the desired additive products, i.e., amides, it will be understood that, as noted hereinabove, additional amino substituted heterocycles may be used to produce the compounds for the present invention. Such nitrogen compounds include, for example, unsubstituted as well as hydrocarbyl substituted pyridines, pyrazine, pyrimidine, pyridazine, quinoline, isoquinoline, phthalazine, quinoxaline, quinazoline, triazine and the like.

One of the amino substituted nitrogen heterocyclic compounds which are suitable for employment in the production of the condensation products of the present invention has the following formula:

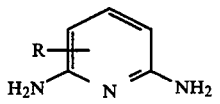

wherein R is a hydrocarbyl group comprising hydrogen, alkyl, alkoxy, alkaryl, alkenyl, alkedienyl, alketrienyl, cycloalkyl, cycloalkenyl, cycloalkedienyl, geranyl, neryl, linalyl, phytyl, pinanyl, abietyl and the like. 2,6-Diaminopyridine is a particularly effective nitrogen heterocycle for use in producing the condensation reaction products of the present invention.

Generally speaking, the condensation products are produced by reaction of the nitrogen heterocycle with a monocarboxylic acid of the formula:

RCOOH wherein R is an alkenyl group, an alkedienyl group or an alketrienyl group containing 2 to 50 carbon atoms. The R groups, therefore, will contain, one, two or three double bonds. Specific illustrations of the useful acids include but are not limited to myristoleic acid, palmitoleic acid, oleic acid, linoleic acid, linolenic acid, elaidic acid, brassidic acid, limolelaidic acid, arachidonic acid, abietic acid and the like.

The reaction between the amino substituted pyridine and the acid is a condensation reaction. In carrying it out, stoichiometric amounts are preferred. The temperature will range from about 150° C. to about 275° C., preferably from about 170° C. to about 225° C. Optimum yield will be obtained at these temperatures in from about 1 hour to about 8 to 10 hours.

Following completion of the reaction with the unsaturated acid, the product can then be sulfurized by reacting it with elemental sulfur at temperatures of from about 150° C. to about 225° C. Although it is known that the product obtained is complex and that it varies according to the temperatures used, the exact structure is not known. However, the sulfurization probably proceeds in accordance with the well known fact that attack occurs at the double bond at 150° C. or below and at the allylic positions at temperatures of from about 180° C. to about 200° C. Further, in carrying out the reaction, a stoichiometric amount of sulfur is preferred, but a small excess may be employed if so desired. In addition to elemental sulfur, any suitable sulfur derivatives may be used.

It has been found that attack by sulfur at the allylic position gives a more active rust inhibitor. It is known that this more desirable derivative can be prepared at a lower temperature by using dimethylformamide or other polar aprotic solvent such as dimethylsulfoxide. Such solvents not only moderate the temperature, but they also direct the sulfur attack to the allylic position.

The lubricants which are to be improved by the novel condensation products of this invention may be both mineral and synthetic lubricating oils, and greases made therefrom. The mineral oils will be understood to embrace not only the paraffinic, but also the naphthenic members. By synthetic oils are meant synthetic hydrocarbons, polyalkylene oxide oils, polyacetals, polysilicones and the like, as well as synthetic ester oils. Of the latter type, there may be mentioned those esters made from monohydric alcohols and polycarboxylic acids, such as 2-ethylhexyl azelate and the like, and those made from polyhydric alcohols and aliphatic monocarboxylic acids. Those of this group are especially important, and they include esters prepared from the trimethylols, such as the ethane, propane and butane derivatives thereof, 2,2-disubstituted propane diols and the pentaerythritols with aliphatic monocarbon atoms. Mixtures of these acids may be used to prepare the esters. Preferred in the practice of this invention are the esters prepared from a pentaerythritol and a mixture of $C_5$–$C_9$ acids. In making such esters, a generally acceptable product can be made from commercial pentaerythritol containing about 88% of monopentaerythritol and 12% dipentaerythritol.

The following examples will illustrate methods for the production of the novel compounds which comprise the compositions of the present invention as well as illustrating their effectiveness as rust inhibitors in lubricant compositions. These examples are intended solely for purposes of illustrating specific embodiments of the present invention and accordingly should not be construed in a limiting sense.

The 2,6-diaminopyridine used in the following examples is commercially available. However, it may be produced from coal tar or it can be produced by the reaction of pyridine with liquid excess ammonia in the presence of alkali metal, as an extended Chichibabin reaction.

EXAMPLE 1

A mixture of 2,6-diaminopyridine (10.9 g, 0.1 mole); oleic acid (28.24 g., 0.1 mole) and xylene (25 ml.) was placed in a flask and brought slowly to 195°–200° C. while the water formed, as a result of the condensation reaction, was collected in an attached water trap. This mixture was held at 195°–200° C. for 1 hour under a nitrogen blanket with continuous stirring. Subsequently the xylene solvent and any volatiles present were distilled off under reduced pressure. The reaction product recovered weighed 37 grams.

EXAMPLE 2

A sample of the reaction product of Example 1 (condensation reaction product of 2,6-diaminopyridine and oleic acid), approximately 17 grams, was placed in a flask. Dimethylformamide (30 ml.) was added followed by the addition of 6.4 grams of elemental sulfur. The mixture was slowly heated to 140°–150° C. and the dimethylformamide was slowly distilled off over a period of 1 hour. The residual solvent and any volatiles were subsequently distilled off under reduced pressure. The evolution of hydrogen sulfide was observed and monitored throughout the heating-distillation step. The reaction product residue weighed 21 grams.

EXAMPLE 3

Abietic (30 g., 0.1 mol) and 2,6-diaminopyridine (10.9 gram, 0.1 mol.) and about 25 ml of a xylene solvent were reacted under the conditions described in Example 1. The condensation product yield was approximately 38 grams.

EXAMPLE 4

Twenty grams of the condensation reaction product of Example 3 were dissolved in dimethylformamide with 6.4 grams of elemental sulfur under the conditions as described in Example 2. The sulfurized condensation reaction product yield was approximately 23 grams.

EVALUATION OF THE PRODUCTS

Rust Test

The test used was ASTM D1743 modified as follows:
Test duration: 24 hours
Additive concentrations: 5% by weight
Distilled water replaced with 5% synthetic sea water.

The results, using a grease comprising a blend of refined naphthenic and paraffinic mineral oils, thickened with 8.5% by weight of lithium hydroxystearate soap to an $NLGI_2$ (National Lubricating Grease Institute) constancy, and also containing a minor amount of antioxidant, antiwear, extreme pressure and metal deactivator additives, but no rust inhibitor, (except Composition 1) are shown in Table 1.

TABLE I

| COMPOSITION | ADDITIVE OF EXAMPLE | % WT. OF ADDITIVE | ESTIMATED % OF SURFACE RUSTED | D1743 RATING |
|---|---|---|---|---|
| 1 | | 0 | 10;15 | 3;3* |
| 2 | 1 | 5 | -;-;5 | 2;3 |
| 3 | 2 | 5 | **;** | 1;1 |
| 4 | 3 | 5 | **;** | 1;1 |

TABLE I-continued

| COMPOSITION | ADDITIVE OF EXAMPLE | % WT. OF ADDITIVE | ESTIMATED % OF SURFACE RUSTED | D1743 RATING |
|---|---|---|---|---|
| 5 | 4 | 5 | 2;5 | 3;3 |

*Grease only
**Indicates no rust
In the table, the ranges were determined according to the following scale:
1 = a bearing showing no corrosion
2 = a bearing showing no more than three spots of a size just sufficient to be visible to the naked eye
3 = a bearing having more than three spots

What is claimed is:

1. A sulfurized product obtained by the reaction of a hydrocarbyl amino substituted nitrogen heterocyclic compound with an unsaturated monocarboxylic acid of the formula:

RCOOH wherein R is an alkenyl group, and alkedienyl group or an alketrienyl group containing from about 2 to about 50 carbon atoms in substantially stoichiometric amounts at a temperature of from about 150° to 275° C. to produce a product and thereafter sulfurizing said product with a substantially stoichiometric amount of elemental sulfur at a temperature of from about 150° to about 225° C.

2. The product of claim 1 wherein said hydrocarbyl amino substituted nitrogen heterocyclic compound is selected from the group consisting of hydrocarbyl pyridines, pyrazine, pyrimidine, pyridazine, quinoline, isoquinoline, phthalazine, quinoxaline, quinazoline, triazine and their alkenyl, alkedienyl, alketrienyl, cycloalkyl, cycloalkenyl, cycloalkedienyl, geranyl, neryl, linalyl, phytyl, pinanyl and abietyl derivatives.

3. The product of claim 2 wherein the hydrocarbyl amino substituted nitrogen heterocycle compound is 2,6-diaminopyridine.

4. The composition of claim 1 wherein the product is prepared from a monocarboxylic acid of the formula

R—COOH and wherein R is an alkenyl group, an alkedienyl group or an alketrienyl group having from 2 to about 50 carbon atoms.

5. The composition of claim 4 wherein said acid is selected from the group consisting of substituted and unsubstituted hydrocarbyl pyridines, pyrazine, pyrimidine, pyridazine, quinoline, isoquinoline, phthalazine, quinoxaline, quinazoline, triazine and their alkenyl, alkedienyl, alketrienyl, cycloalkyl, cycloalkenyl, cycloalkedienyl, geranyl, neryl, linalyl, phytyl, pinanyl and abietyl derivatives.

6. The product of claim 1 in which said product is sulfurized by reaction with elemental sulfur at a temperature of from about 150° to about 225° C.

7. A product obtained in the reaction of a hydrocarbyl amino substituted nitrogen heterocyclic compound selected from the group consisting of pyridine, pyrazine, pyrimidine, pyridazine, quinoline, isoquinoline, phthalazine, quinoxaline, quinazoline, triazine and their alkenyl, alkedienyl, alketrienyl, cycloalkyl, cycloalkenyl, cycloalkedienyl, geranyl, neryl, linalyl, phtdhyl, pinanyl and abietyl derivatives with an unsaturated monocarboxylic acid having from about 2 to about 50 carbon atoms in substantially stoichiometric amounts at a temperature of from about 150° to about 275° C. and sulfurizing the reaction products thereof by reacting same with substantially stoichiometric amounts of elemental sulfur or a sulfur derivative at temperatures of from about 150° to about 225° C.

8. The product of claim 7 wherein the monocarboxylic acid is selected from the group consisting of myristoleic acid, palmitoleic acid, oleic acid, linoleic acid, linolenic acid, elaidic acid, brassidic acid, limolelaidic acid, arachidonic acid and abietic acid.

9. The product of claim 7 wherein elemental sulfur in substantially stoichiometric amounts is used.

10. A lubricant composition comprising a major proportion of a mineral lubricating oil, a synthetic lubricating oil or a grease from either of these, and a minor effective anti-rust amount of the product as defined in claim 1.

11. A lubricant composition comprising a major proportion of a mineral lubricating oil, a synthetic lubricating oil or a grease from either of these, and a minor effective anti-rust amount of the product as defined in claim 7.

12. The product of claim 1 wherein the monocarboxylic acid is selected from oleic and abietic acids and said nitrogen heterocyclic compound is 2,6-diaminopyridine.

* * * * *